United States Patent [19]

Littke et al.

[11] Patent Number: 4,721,430

[45] Date of Patent: Jan. 26, 1988

[54] RAILROAD TRACK VEHICLE

[75] Inventors: Mark E. Littke, Kamloops; Jack Buss, Delta, both of Canada

[73] Assignee: Brentwood Enterprises Ltd., Burnaby, Canada

[21] Appl. No.: 30,289

[22] Filed: Mar. 23, 1987

Related U.S. Application Data

[63] Continuation of Ser. No. 548,664, Nov. 4, 1983, abandoned.

[51] Int. Cl.[4] ..... B60P 1/00

[52] U.S. Cl. ..... 414/537; 105/96.2; 105/159; 105/215.1; 105/27; 295/1; 180/53.4; 180/198

[58] Field of Search ..... 105/96.2, 159, 27, 187, 105/64 R, 198, 238 R, 199.5, 203, 215.1; 280/111, 112 R; 295/1, 7, 34; 301/5 R, 6 WB; 305/46; 180/14.3, 53.4, 198; 414/537, 533

[56] References Cited

U.S. PATENT DOCUMENTS

| | | | |
|---|---|---|---|
| 915,071 | 3/1909 | Carr | 295/1 |
| 1,219,647 | 3/1917 | Lake | 105/159 |
| 1,417,653 | 5/1922 | Woodard | 105/187 |
| 1,726,771 | 9/1929 | Ronk | 105/27 |
| 1,908,959 | 5/1933 | Cullen et al. | 105/27 X |
| 1,934,348 | 11/1933 | Flynn | 105/159 X |
| 2,168,900 | 8/1939 | Eaton | 295/7 X |
| 3,019,742 | 2/1962 | Kershaw | 105/177 |
| 3,101,214 | 8/1963 | Talboys | 295/1 |
| 3,160,116 | 12/1964 | Kugel | 105/96.2 |
| 3,926,128 | 12/1975 | Zappel | 105/159 X |
| 4,029,331 | 6/1977 | Obearle | 280/112 R |
| 4,047,587 | 9/1977 | Anstey | 180/53.4 |
| 4,060,035 | 11/1977 | Swoager | 105/177 |
| 4,435,113 | 3/1984 | Mosely et al. | 414/537 |
| 4,480,554 | 11/1984 | Brodeur et al. | 105/199 S X |

FOREIGN PATENT DOCUMENTS

| | | | |
|---|---|---|---|
| 212612 | 12/1960 | Austria | 180/53.4 |
| 895520 | 5/1962 | United Kingdom | 295/7 |
| 686920 | 10/1979 | U.S.S.R. | 105/199 S |

*Primary Examiner*—Joseph F. Peters, Jr.
*Assistant Examiner*—Paul E. Salmon

[57] ABSTRACT

A vehicle for use in transporting heavy equipment having a hydraulic system including a hydraulic pump, which vehicle has a hydraulic motor arranged to drive a pair of railroad track wheels. The vehicle also has an arrangement such that the hydraulic motor of the vehicle can be releasably interconnected with the hydraulic system of the heavy equipment to drive the former from the latter. A ramp can be reversibly lowered to an inclined position to facilitate loading and unloading of the heavy equipment onto the vehicle. The railroad track wheels are each electrically insulated from their corresponding axles.

6 Claims, 5 Drawing Figures

RAILROAD TRACK VEHICLE

This is a continuation of application Ser. No. 548,644, filed Nov. 4, 1983, now abandoned.

BACKGROUND OF THE INVENTION

The present invention relates to a vehicle for transporting heavy equipment having hydraulic systems over railroad tracks utilizing the hydraulic system of the heavy equipment to drive a hydraulic motor means on the railroad track vehicle.

Of known vehicles for transporting heavy equipment over railroad tracks, one has utilized four separate wheels each independently connected to the frame with two of the wheels at one end of the vehicle each driven by a separate hydraulic torque motor. Such an arrangement has been vulnerable to fracture of the axles through slippage of the wheels over a portion of the track followed by subsequent gripping of the wheel in a manner which induces an excessive strain on the axle. Other vehicles have employed axles which are affixed directly to the frame. In such arrangements when an uneven portion of the track is encountered, one wheel of the vehicle lifts off of the track making the vehicle subject to derailment.

Inasmuch as it is often necessary for vehicles used for transporting heavy equipment over railroad tracks to be stationed near areas where electrically shorting across the tracks causes highway crossing barriers to be activated and alarms to ring it is desirable to have the wheels on one side of the track insulated from the other side in order to prevent such tripping of alarms and activating of barriers. No known method of insulation has achieved a means for insulating the wheels in such a way as permits adjustment of the wheels to variations in elevation of the track so as to avoid derailment and to prevent sudden application of torque to the axles when wheels encounter slippery areas of the track followed by areas which are not slippery.

SUMMARY OF THE INVENTION

A vehicle is provided which is adapted for use in transporting heavy equipment having a hydraulic system which includes a hydraulic pump. The vehicle comprises a frame, and first and second pairs of railroad track wheels. A first axle interconnects the first pair of wheels so that the first pair always rotate together in synchronization. Means are provided for rotatably connecting the first axle to the frame. A hydraulic motor is connected to the first axle so as to simultaneously drive both wheels of the first pair of wheels. Means are also provided for releasably interconnecting the hydraulic motor with the hydraulic system of the heavy equipment so that the hydraulic motor can be driven therefrom.

Preferably the vehicle additionally comprises ramp means on at least one side of the vehicle, which ramp means can be reversibly lowered to an inclined position. The ramp means is for providing a ramp upon which the heavy equipment can be loaded and unloaded onto the vehicle.

The vehicle may further usefully additionally comprise a second axle interconnecting the second pair of wheels, and means for rotatably connecting the second axle to the frame.

Each of the wheels is advantageously electrically insulated from its corresponding axle. This is accomplished by an electrically insulated intermediate plate located intermediate an annular wheeled plate integral with the wheel, and an intermediate plate coupled to a plate affixed to the axle. In such a case, the vehicle additionally comprises means for rigidly clamping together each of the intermediate plates to an associated one of the wheel plates, so that the intermediate plates are electrically insulated from their associated wheel plate.

Brake means affixed to each of the axles may also usefully be additionally provided. In addition, the clamping means preferably comprises a plurality of insulating sleeves inserted in each of a plurality of bolt holes in one of the axle plate and the wheel plate of each wheel, to insulate bolts inserted therethrough from the one plate.

Usefully, the insulating plate and the sleeve are of an ultra high molecular plastic.

BRIEF DESCRIPTION OF THE DRAWINGS

In the drawings which illustrate a preferred embodiment of the device.

DESCRIPTION OF THE PREFERRED EMBODIMENTS

Figure 1:
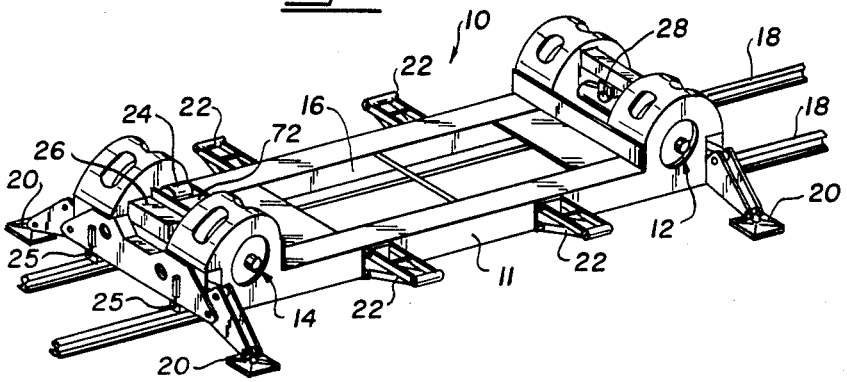
FIG. 1 is a perspective view of the vehicle positioned on a railroad track.
Figure 3:
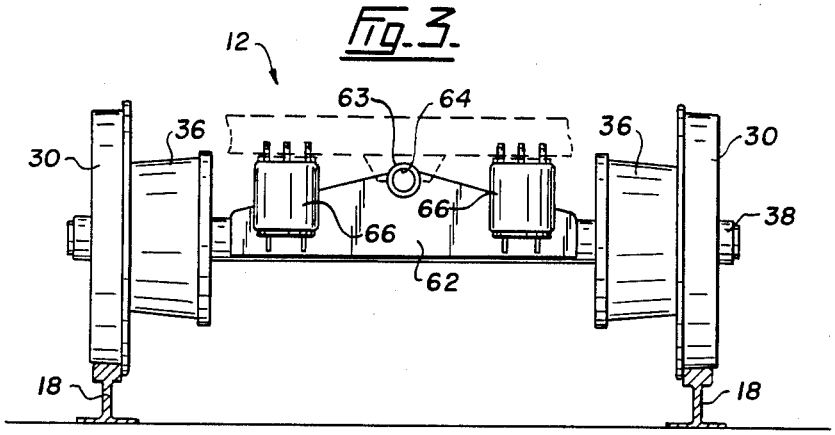
FIG. 3 is a top view of a nondriven axle and wheel assembly of the vehicle.
Figure 4:
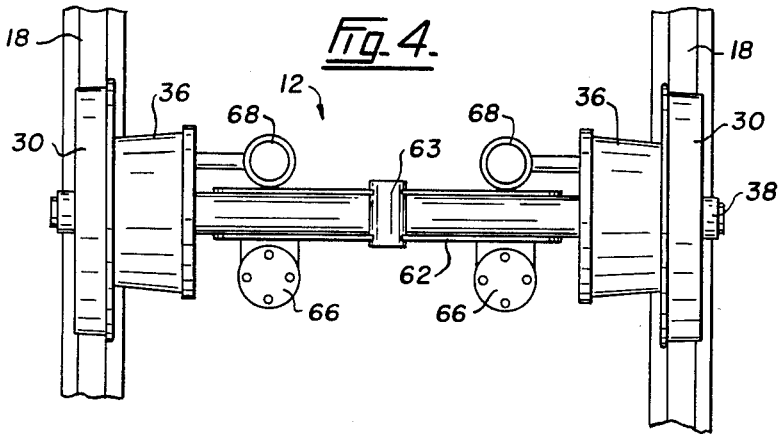
FIG. 4 is a top view of the axle and wheel assembly shown in FIG. 3.

Referring to FIG. 1, a vehicle 10 for transporting the equipment over railroad track lines includes a frame 11 coupled at one end to an undriven wheel and axle assembly 12 and at the other end to a driven wheel and axle assembly 14. The undriven wheel and axle assembly 12 is enclosed within a portion of the frame 11 at one end thereof such that a bore 64 of a cylindrical sleeve 63 located centrally of the undriven axle assembly, shown in FIG. 3, is aligned with an associated opening 28 of the same diameter in the frame 11 as shown in FIG. 1. The wheel and axle assembly 12 is coupled to the frame by a pin snugly slidably inserted through both the opening 28 in the frame and the bore 64.

The driven axle assembly 14 is bolted directly to the frame in a conventional manner. The pairs of wheels 30 are coupled by associated single axles. The central portion of the frame 11 has a flat surface so as to provide a platform 16 for heavy equipment. A pair of ramps 22 located on either side of the platform 16 can be reversibly lowered so as to provide a ramp upon which a treaded item of heavy equipment can be used to climb up onto the platform 16.

At each of the four corners of the vehicle there is located a hydraulically operated support arm and pad assembly 20 which is used to stabliize the vehicle when a piece of heavy equipment is operating from the platform 16. During transport of the heavy equipment over tracks 18 a pair of sweepers 25 located at either end of the vehicle over the track are used to remove objects from the track and prevent derailment.

The vehicle is equipped with a plurality of hydraulic lines leading to various hydraulically operated items on the vehicle such as the pad assemblies 20 and the ramps 22. The hydraulic pump system of the heavy equipment (not shown) is coupled to a single hydraulic torque motor 24, shown in FIG. 1, located on the driven wheel and axle assembly 14 through a coupling means 27. The hydraulic motor 24 is coupled by a gear assembly 26 to drive a single axle 38 connected between the pairs of driven wheels 30 (see FIG. 2).

Figure 2:
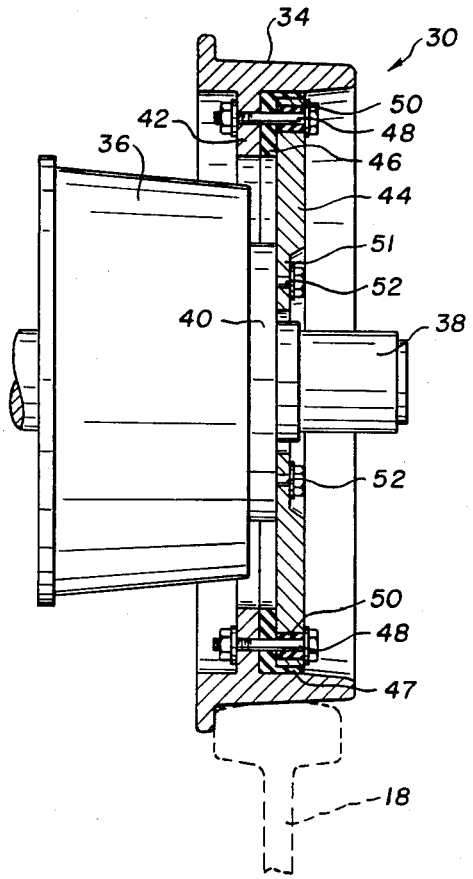
FIG. 2 is an elevation view partly in section of a railroad wheel shown coupled to one end of an axle.

Each wheel of the vehicle is insulated from the track by a structure shown in FIG. 2. The wheel of FIG. 2 has a vertically oriented annular wheel plate 42 with an outer track engaging surface 34 for engaging a track 18. The annular plate 42 is coupled to an annular insulating plate 46 and to an intermediate plate 44 adjacent to the insulating plate 46. The insulating plate 46 has a short sleeve portion 47 which is between a peripheral edge of the intermediate plate 44 and the wheel 30. A coupling of the three plates is accomplished by a plurality of bolts 48 passing through flanged insulation sleeves 50 inserted into enlarged holes in the intermediate plate 44. Thus, the bolts 48 which are spaced around the annular plates proximate the periphery of the latter are electrically connected to the wheel and electrically insulated from the intermediate plate 44. A suitable insulating material has been found to be ultra high molecular plastic available from A.C. Rubber Ltd. in Richmond, British Columbia.

The intermediate plate 44 extends beyond the inner periphery of the annular wheel plate 42 and the insulating plate 46 to form an inner flange 51. The inner flange is directly coupled by a plurality of bolts 52 threadedly received by an axle flange 40 rigidly affixed to the axle 38. FIG. 2 also illustrates the location of a brake drum 36 relative to the wheel which drum is affixed to and rotates with the wheel 34.

FIG. 3 illustrates the undriven wheel and axle assembly 12 which is comprised of a pair of wheels 30, associated brake drums 36 and an axle casing 62. The cylindrical sleeve 63 is welded to the axle casing 62 in this embodiment. A pair of air bags 66 are coupled to corresponding flanges affixed to the frame in order to cushion rotational motion of the frame relative to the axle about the pin connection in bore 64.

Figure 5:
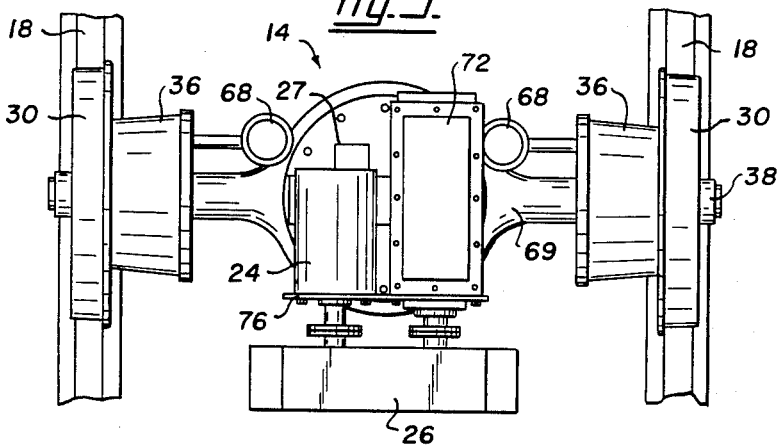
FIG. 5 is a perspective view of a driven axle assembly and wheels of the vehicle.

FIG. 5 illustrates the driven axle assembly in which a pair of wheels 30 interconnected by a single axle 38 rotatable within a casing 69. Directly coupled to the axle and rotatable therewith is a pair of brake drums 36 adjacent associated wheels 30. Brake shoes connected within the brake drums 36 and affixed to the casing 69 are operated by a pair of associated air pumps 68. The brake and wheel system is similar to that of a conventional truck assembly except that the axle is somewhat shorter. The hydraulic torque motor 24 is mounted on top of casing 69 and is fed by pressurized hydraulic fluid available from the hydraulic system of heavy equipment being transported by the vehicle. The motor 24 is reversed by simply reversing the direction of hydraulic fluid flow through it. The motor 24 is affixed to a plate 76 forming part of the casing 69. The motor 24 output shaft is coupled by means of the gear assembly 26 and transmission 72 to a conventional rear end differential contained within the central portion of the casing 69.

In operation a piece of heavy equipment such as an excavator having a pair of treads places the vehicle 10 over a set of tracks 18 so that the wheels of the vehicle 10 engage the tracks 18. The pair of ramps 22 on a selected side of the vehicle are lowered in order that the piece of heavy equipment can climb on top of the platform 16 of the vehicle 10. Once positioned on the platform hydraulic lines are coupled to the hydraulic system of the heavy equipment through coupling means 27, in order that the latter hydraulic system can operate the vehicle 10. The hydraulic system of the heavy equipment is then activated so that hydraulic fluid flows through the hydraulic motor 24 in a selected direction. The latter flow causes the driven axle 38 to rotate and move the vehicle over the tracks in a direction associated with the direction of flow through the torque motor 24. When the vehicle encounters a change in level of the tracks 18 the undriven wheel-axle assembly 12 is able to accommodate for the difference in level by rotating about the central pin connection slidably received in bore 64 of sleeve 63 and corresponding hole 28 in frame 11. The rotation of the undriven axle prevents a situation developing where the wheels of the undriven axle are constrained to be in the same plane as the driven axle by rigid attachment to the frame so that one of the wheels of the vehicle 10 breaks contact with the track 18 when a variation in level of the track is encountered thereby leading to derailment of the vehicle.

By utilizing both wheels coupled to a single axle at either end of the vehicle 10 rather than having each wheel coupled independently to the frame any loss of friction between one wheel and the track is not accompanied by a rapid loss of rotation of that wheel so that when that wheel once again encounters an area of the track where slipping does not occur it is not subjected to a sudden impulse. The present single axle arrangement is therefor, less vulnerable to fracturing as a result of encountering of such an impulse following loss of friction between wheel and track. Additionally, utilization of a single torque motor for driving a single axle coupled to a pair of wheels considerably simplifies the design of the structure.

Once the vehicle has reached a location where the heavy equipment is to be used the hydraulic system of the heavy equipment is activated to cause pads 20 to rotate downwardly and stabilize the frame 11 against movement of the vehicle during operation.

Other departures, modifications and variations lying within the spirit of the invention or the scope as defined by the appended claims will be obvious to those skilled in the art.

We claim:

1. A vehicle for transporting heavy equipment by rail, said equipment having a hydraulic system, the vehicle comprising:

(a) a frame having a longitudinal axis and a surface capable of supporting heavy equipment;

(b) a first axle and wheel assembly having a first pair of wheels rigidly connected to a first axle for rotation therewith, each wheel of the first pair of wheels being electrically insulated from the first axle by an electrically insulated plate located between an annular wheel plate integral with each wheel of the first pair of wheels and an intermediate plate coupled to the first axle;

(c) means for rotatably coupling the first axle and wheel assembly to the frame such that the first axle and wheel assembly is rotatable relative to the frame about a horizontal axis parallel to the longitudinal axis of the frame;

(d) means for cushioning rotation of the first axle and wheel assembly relative to the frame about the horizontal axis;

(e) a second axle and wheel assembly connected to the frame and having:

(i) an axle;

(ii) a second pair of wheels rigidly connected to the second axle for rotation therewith, each wheel of the second pair of wheels being electrically insulated from the second axle by an electrically insulated plate located between an annular wheel plate integral with each wheel of the second pair of wheels and an intermediate plate coupled to the second axle;

(iii) a casing enclosing the axle and extending towards the wheels, the second axle being rotatable in the casing; and (iv) a pair of brakes having drums mounted on the second axle between the casing and each of the wheels of the second pair of wheels;

(f) a drive train for the vehicle including a hydraulic motor operatively connected to the second axle for driving the second axle and wheel assembly;

(g) ramp means on at least one side of the vehicle, which can be reversibly lowered to an inclined position, for providing a ramp upon which the heavy equipment can be loaded on, or unloaded from the vehicle; and (h) means for stabilizing the vehicle when said heavy equipment is operating on the surface of the frame.

2. A vehicle as claimed in claim 1, further comprising means for rigidly clamping together each of the intermediate plates to its associated insulating plate and its associated wheel plate, so that each intermediate plate is electrically insulated from its associated wheel plate.

3. A vehicle as defined in claim 2 wherein said clampling means further comprises a plurality of flanged insulating sleeves inserted in each of a plurality of bolt holes extending through said intermediate axle plate and said wheel plate of each wheel to insulate bolts inserted therethrough.

4. A vehicle as defined in claim 3, wherein the material of said electrically insulating plate and said flanged insulating sleeves is an ultra high molecular plastic.

5. A vehicle as claimed in claim 1, wherein the means for cushioning is a pair of air bags mounted between the first axle and the frame, one on each side of said horizontal axis.

6. A vehicle as claimed in claim 1, wherein the means for stabilizing comprises support arm and pad assemblies on each side of the vehicle.

* * * * *